US005353521A

United States Patent [19]

Orloff

[11] Patent Number: 5,353,521

[45] Date of Patent: Oct. 11, 1994

[54] METHOD AND APPARATUS FOR DRYING WEB

[75] Inventor: David I. Orloff, Atlanta, Ga.

[73] Assignee: Institute of Paper Science and Technology, Inc., Atlanta, Ga.

[21] Appl. No.: 758,775

[22] Filed: Sep. 12, 1991

Related U.S. Application Data

[62] Division of Ser. No. 417,261, Oct. 15, 1989, Pat. No. 5,101,574.

[51] Int. Cl.[5] ..... F26B 11/02

[52] U.S. Cl. ..... 34/110; 34/113

[58] Field of Search ..... 34/110, 113; 162/202, 162/211, 217, 352, 361, 374; 29/132

[56] References Cited

U.S. PATENT DOCUMENTS

| | | | |
|---|---|---|---|
| 2,209,759 | 7/1940 | Berry | 162/361 |
| 3,456,931 | 7/1969 | Ermenc et al. | 29/132 |
| 4,888,095 | 12/1989 | Gulya et al. | 34/110 X |
| 4,912,835 | 4/1990 | Harada et al. | 29/132 |

*Primary Examiner*—Henry A. Bennet
*Attorney, Agent, or Firm*—Fitch, Even, Tabin & Flannery

[57] ABSTRACT

The present invention is directed to a method and apparatus for drying a web of paper utilizing impulse drying techniques. In the method of the invention for drying a paper web, the paper web is transported through a pair of rolls wherein at least one of the rolls has been heated to an elevated temperature. The heated roll is provided with a surface having a low thermal diffusivity of less than about $1\times10^{-6}$ m$^2$/s. The surface material of the roll is preferably prepared from a material selected from the group consisting of ceramics, polymers, glass, inorganic plastics, composite materials and cermets. The heated roll may be constructed entirely from the material having a low thermal diffusivity or the roll may be formed from metal, such as steel or aluminum, or other suitable material which is provided with a surface layer of a material having a low thermal diffusivity.

3 Claims, 4 Drawing Sheets

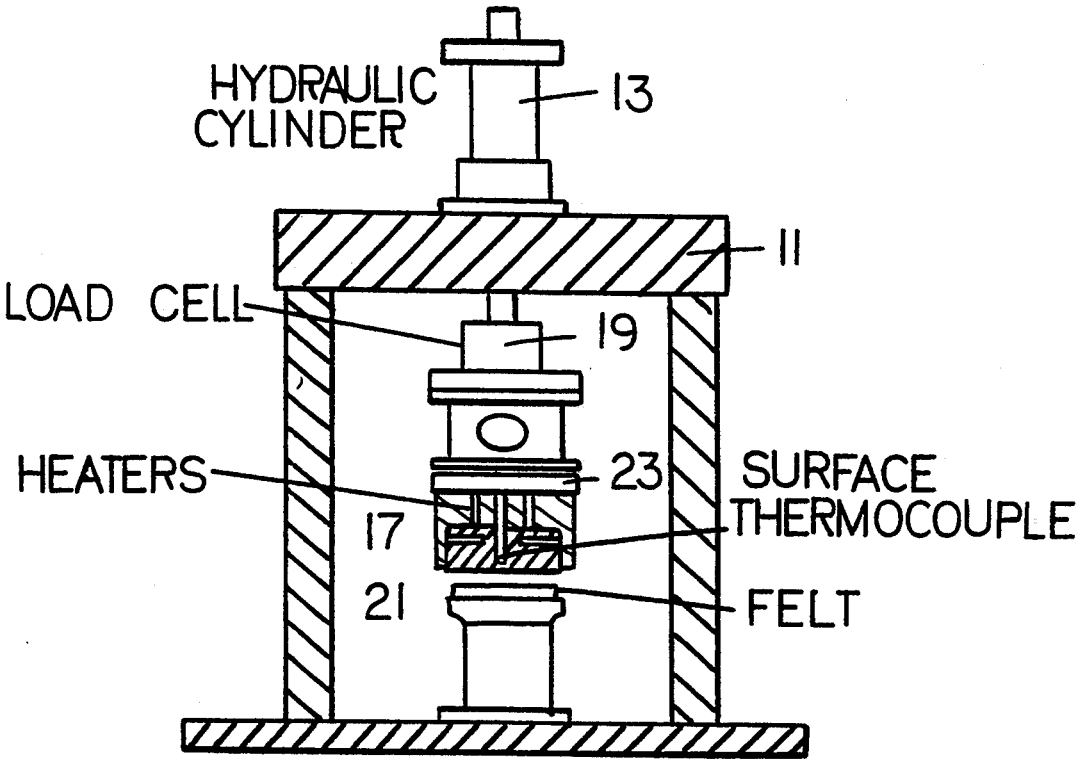
FIG.1 ELECTROHYDRAULIC PRESS, MTS
FIG.2 DELAMINATION ZONES
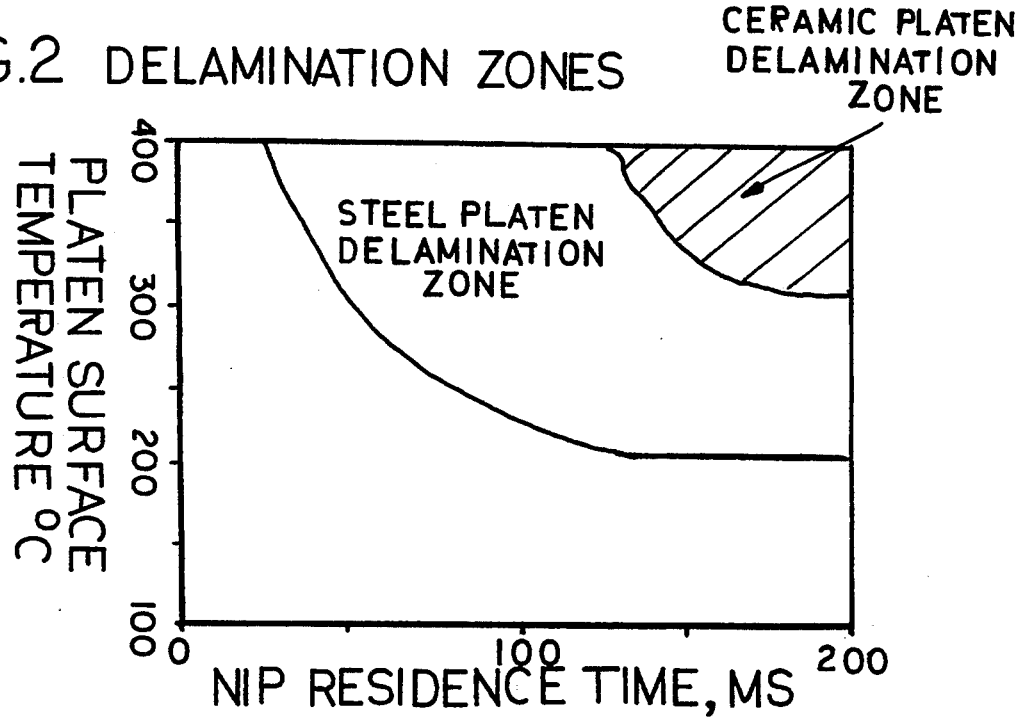

FIG.3 SOLIDS OUT
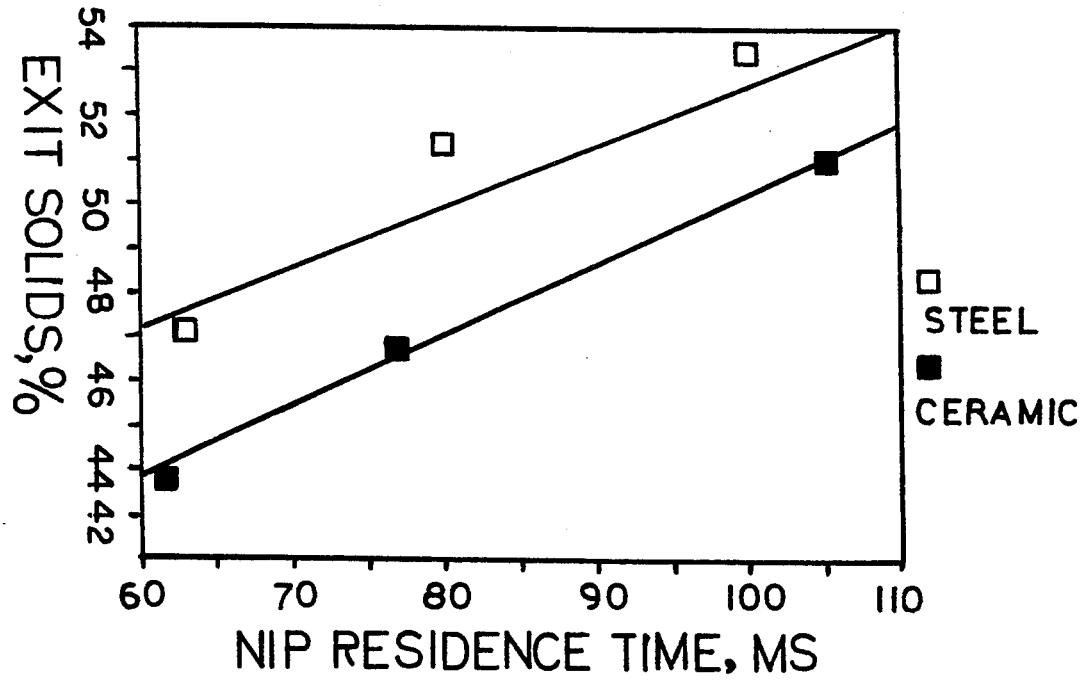
FIG.4 DENSITY
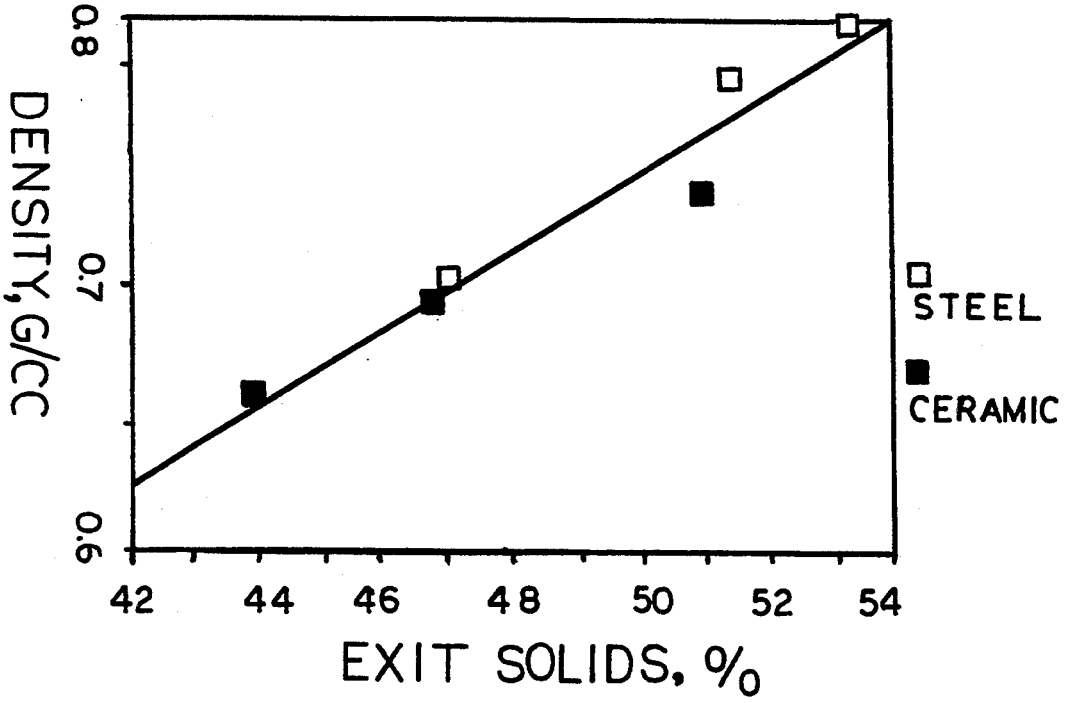

FIG.5 Z-DIRECTION MODULUS.
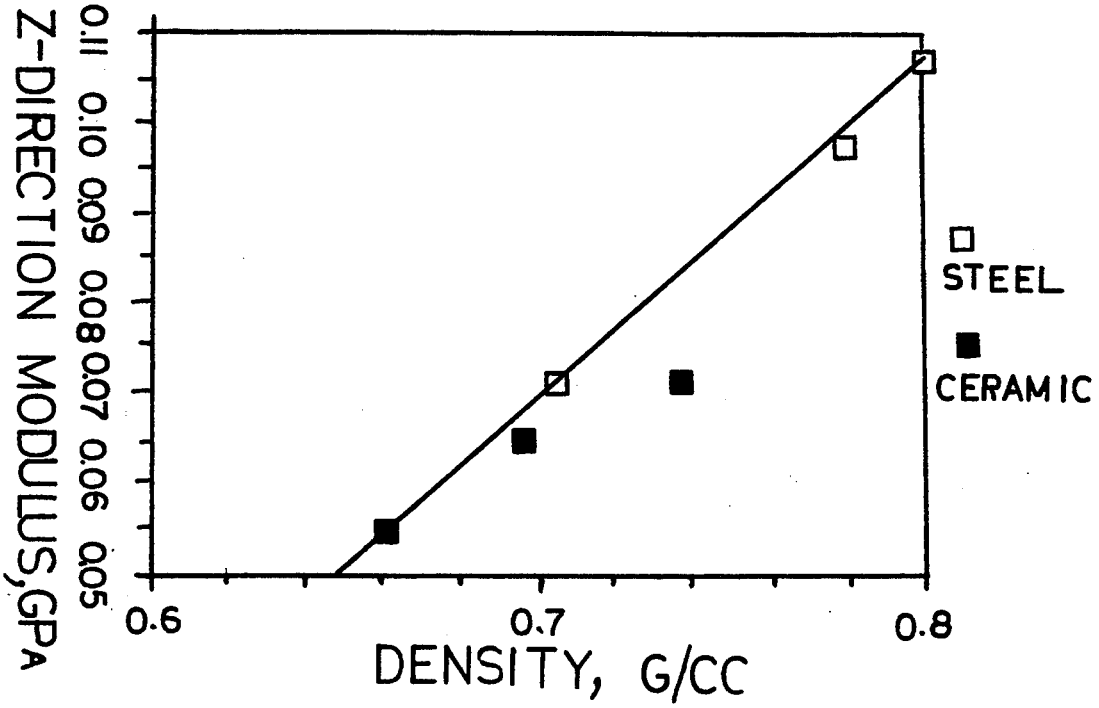
FIG.6 INSTANTANEOUS HEAT FLUX.
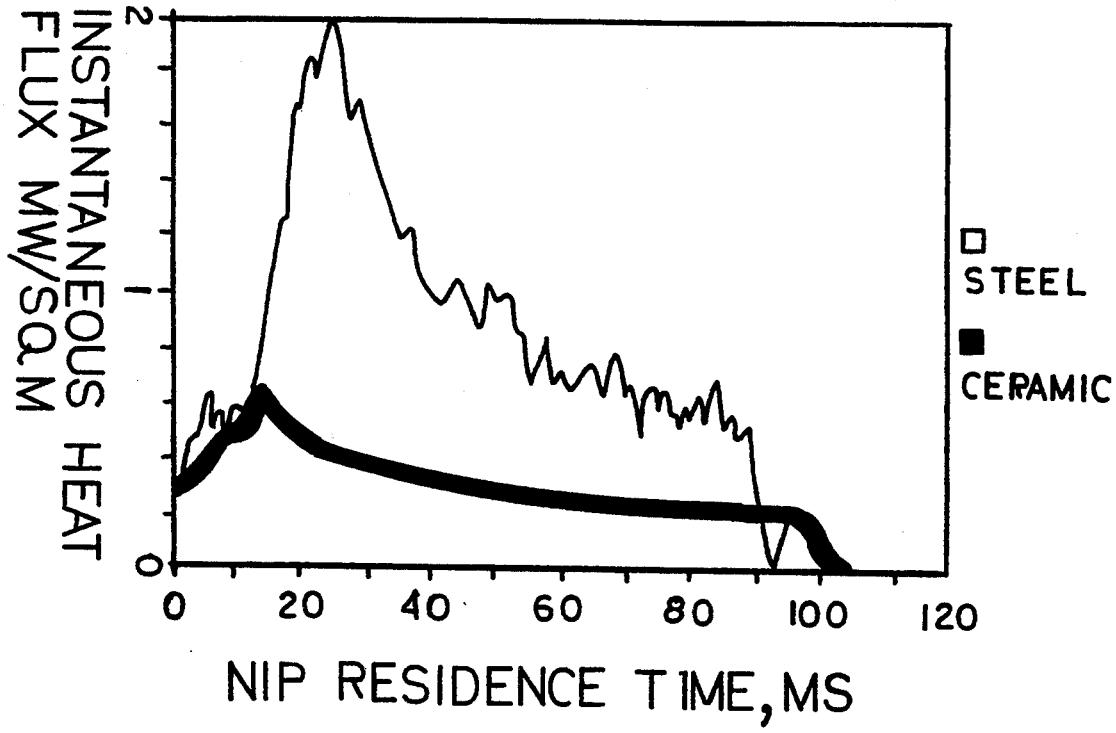

FIG. 7 TOTAL ENERGY.
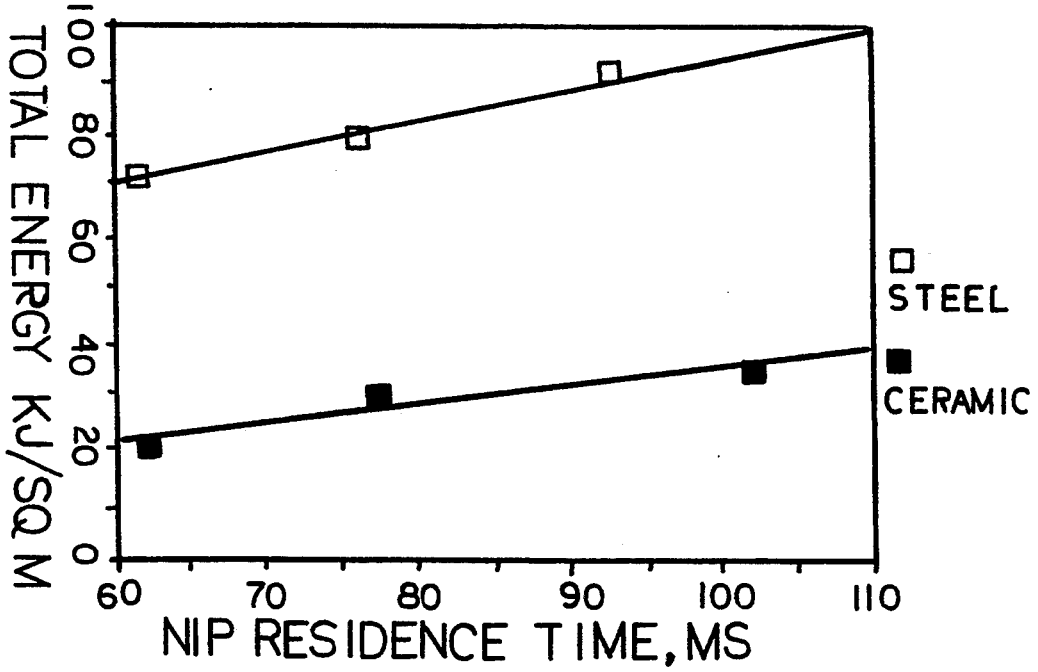
FIG. 8 TOTAL ENERGY VS. EXIT SOLIDS.
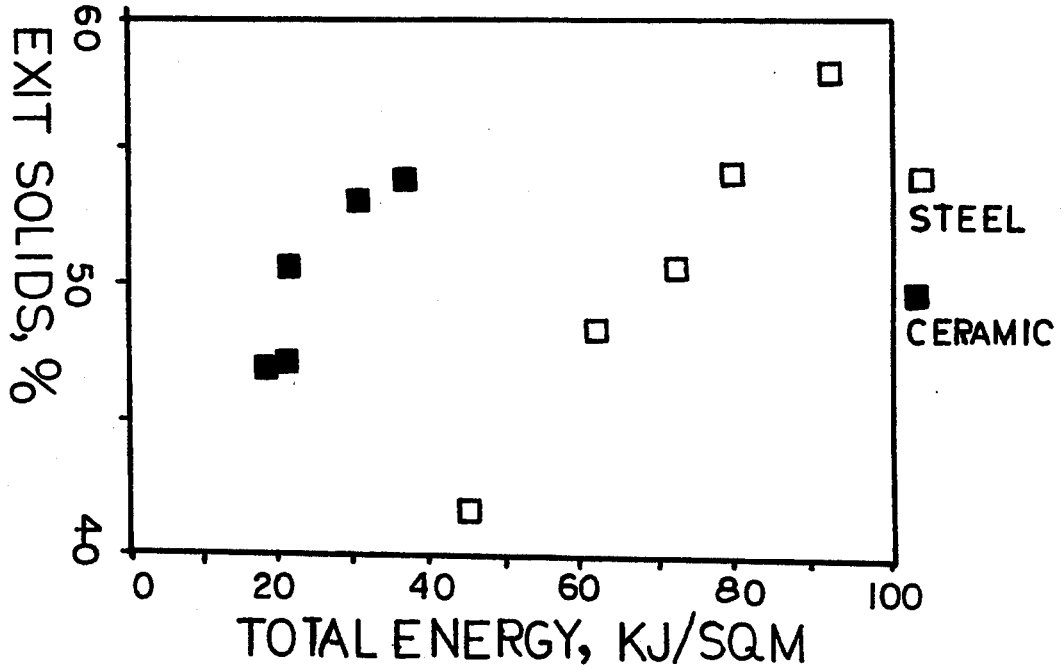

METHOD AND APPARATUS FOR DRYING WEB

This is a division of application Ser. No. 417,261, filed Oct. 15, 1989, now U.S. Pat. No. 5,101,574.

FIELD OF THE INVENTION

The present invention relates generally to a method and apparatus for drying a wet paper web as it passes through the press nip of a pair of rolls in which one of the pair of rolls is heated to a high temperature. More particularly, the present invention relates to impulse drying of a wet paper web through use of a heated roll having a surface with a low thermal diffusivity.

BACKGROUND OF THE INVENTION

Impulse drying occurs when a wet paper web passes through the press nip of a pair of rolls in which one of the rolls is heated to a high temperature. A steam layer adjacent to the heated surface grows and displaces water from the sheet in a more efficient manner than conventional evaporative drying. It is projected that wide commercialization of impulse drying would result in very large industry wide energy savings.

In addition to the impact on energy consumption, impulse drying also has an effect on paper sheet structure and properties. Surface fiber conformability and interfiber bonding are enhanced by transient contact with the hot surface of the roll. As the impulse drying process is usually terminated before the sheet is completely dried, internal flash evaporation results in a distinctive density profile through the sheet that is characterized by dense outer layers and a bulky midlayer. For many paper grades, this translates into improved physical properties. The persistent problem with the use of impulse drying, however, is that flash evaporation can result in delamination of the paper sheet. This is particularly a problem with heavy weight grades of paper and it has not been possible to predict under what conditions delamination will occur. This has been a major constraint as to the commercialization of impulse drying.

It has been reported, Crouse, J. W. et al, "Delamination: A Stumbling Block to Implementation of Impulse Drying Technology for Liner Board", Tappi Engineering Conference, Atlanta, Ga., Sept. 13, 1989, that various degrees of delamination were experienced with liner board dried at press roll surface temperatures above 150° C. (300° F.). When delamination was avoided by operating at the lowest limit, water removal efficiencies were not significantly different than those obtained by conventional drying. It was concluded in this report that to realize the potential of impulse drying it would be necessary to alleviate delamination.

In laboratory scale simulations, Lavery, H. P., "High Intensity Drying Processes-Impulse Drying Report" Three DOE/CE/40738-T3, February 1988, it was found that increased pulp refining encouraged delamination and it was postulated that very thick or highly refined sheets exhibit greater resistance to the flow of vapor than thin or coarse paper webs. Hence, if the flow resistance of the web became so large that high pressure steam could not escape, the sheet may not be strong enough to sustain the pressurized vapor and delamination would occur.

The effect of hot surface materials on delamination has been investigated, Santkuyl, R. J., "The Effect of Hot Surface Material on Delamination in Impulse Drying", Master's Program, Institute of Paper Science and Technology, March 1989. Using an electrohydraulic impulse drying press simulator, carbon steel, aluminum and sintered porous stainless steel platens were tested in terms of their ability to dewater and suppress delamination. A felt back-up pad was used in the simulations. It was observed that a difference in thermal diffusivity between steel ($1.1\times10^{-5}$ $m^2/s$) and aluminum ($6.8\times10^{-5}$ $m^2/s$) had no affect on dewatering capacity or the propensity for paper sheets to delaminate. Porous stainless steel (thermal diffusivity of $2\times10^{-6}$ $m^2/s$) platens provided completely suppressed delamination, although also providing considerably lower dewatering capacity. For porous materials, such as sintered porous stainless steel, a mass balance on the paper sheet showed that a large fraction of the water was removed as vapor and a much smaller fraction was displaced as liquid water into the backup felt. It was concluded that the porous platens do not operate by an impulse drying mechanism. Instead, steam formation and venting at the hot platen-vapor interface augmented by hot pressing were considered to be responsible for water removal. As a resulting of venting, measured temperatures within the vapor sheets never exceeded 100° C. (212° F.) and flash evaporation could not occur.

Accordingly, it is a principal object of the present invention to provide a roll surface material which is suitable for use in impulse drying over a broad range of temperatures and nip residence times but wherein delamination of the paper web is prevented.

It is another object of the present invention to provide a roll surface material that can be heated for impulse drying and can attain efficiencies comparable to that of solid steel rolls but which do not result in delamination of the paper web under high energy transfer conditions.

DESCRIPTION OF THE DRAWINGS

FIG. 1 is a schematic diagram of an electrohydraulic press that is designed to simulate impulse drying;

FIG. 2 is a plot of residence time versus the platen surface temperature;

FIG. 3 is a plot of the solids remaining after impulse drying at various nip residence times for steel and ceramic platens;

FIG. 4 is a plot of density at various exit solids for steel and ceramic platens;

FIG. 5 is a plot of Z-direction modulus versus density for steel and ceramic platens;

FIG. 6 is a plot of instantaneous heat flux versus residence time for steel and ceramic platens;

FIG. 7 is plot of total energy versus nip residence time for steel and ceramic platens; and FIG. 8 is a plot of exit solids versus total energy for steel and ceramic platens.

SUMMARY OF THE INVENTION

The present invention is directed generally to a method and apparatus for drying a web of paper utilizing impulse drying techniques. In the method of the invention for drying a paper web, the paper web is transported through a pair of rolls wherein at least one of the rolls has been heated to an elevated temperature. The heated roll is provided with a surface having a low thermal diffusivity of less than about $1\times10^{-6}m^2/s$. The surface material of the roll is preferably prepared from a material selected from the group consisting of ceramics, polymers, glass, inorganic plastics, composite materials and cermets. The heated roll may be constructed entirely from the material having a low thermal diffusivity or the roll may be formed from steel or other suitable material which is provided with a surface layer of a material having a low thermal diffusivity.

DETAILED DESCRIPTION OF THE INVENTION

The present invention is directed to the discovery that the probability of delamination during impulse drying can be substantially reduced by reducing the energy released during flash evaporation. In accordance with the present invention the thermal diffusivity of the surface of the heated roll is reduced to such an extent that the energy transferred to the paper web in the later stages of the impulse drying process is substantially reduced, thereby reducing the energy available for flash evaporation. It should be understood that this is substantially different from the use of a porous platen which prevents the occurrence of flash evaporation in that, in accordance with the present invention, the strength of the flash evaporation is reduced rather than preventing its occurrence.

In accordance with the invention, a roll is provided for use in impulse drying which has a solid surface having a low thermal diffusivity of less than about $1\times10^{-6}$ m$^2$/s. The surface material of the steel roll, or the roll may be constructed of the material having the low thermal diffusivity. Preferably, the thermal diffusivity of the surface of the roll is from about $1\times10^{-7}$ to about $1-10^{-6}$ m$^2$/s.

Thermal diffusivity is the quantity $K/\rho C_v$, where K is the thermal conductivity, $\rho$ is the density and $C_v$ is the specific heat. The magnitude of this quantity determines the rate at which a body with a nonuniform temperature approaches equilibrium. The unit of thermal diffusivity, after cancelling like terms, is meter$^2$ per second (m$^2$/s).

The roll surface material having a low thermal diffusivity may be prepared from a material selected from the group consisting of ceramic, polymers, inorganic plastic, glass, composite materials and cermets.

Ceramics are non-metallic-inorganic materials containing high proportions of silicon, silicon oxide, silicates, aluminum oxide, magnesium oxide, zirconium oxide and other metal oxides. One group of ceramics is prepared from mixtures of powders of clay, flint and feldspar. Triaxial ceramics are those prepared from the foregoing three components with occasional secondary fluxes, such as lime and magnesia. Non-triaxial ceramics contain other components such as talc, bone ash, pyrophyllite and alumina. One suitable type of ceramics are those having a high proportion of alumina or zirconia of above about 30%. Ceramics are formed by preparing a mixture of the ceramic powder with various amounts of water and thereafter forming the ceramic product by slip casting, jiggering, drain casting, extrusion or pressing. Ceramics can also be applied to a suitable substrate, such as a steel or aluminum roll, by plasma spraying. Thereafter, the formed ceramic is subjected to one or more heat processes to sinter the powder and form the solid ceramic.

Any suitable polymer can be used for the surface material of the roll of the invention which has a melting point in excess of 200° C. (392° F.). Suitable polymers can be selected by reference to a table of structural properties, such as that contained in the Encyclopedia of Modern Plastics, McGraw-Hill, Inc., mid-October 1988 issue, Volume 65, No. 11, pp 576–619. Representative polymeric products which are suitable as the surface material of the present invention include polyamides, polyacrylonitrile, polyester, fluoroplastics, such as polytetrafloroethylene, polychlorotrifloroethylene, and fluorenated ethylene propylene, melamineformaldehyde, phenolics, such as melaminephenolic, polyesters, polyimides, and sulfone polymers.

Any common glass, including ceramic glasses (Pyroceramps), can be used for the surface material of the roll of the invention. Common glass is essentially a sodium calcium silicate in composition. Potassium, barium, zinc, lead, alumina and boron are also often used in various amounts to provide particular properties. The ceramic glasses are produced from irradiated glass by heating them several hundred degrees above the temperature necessary for the development of opacity or color. Ceramic glasses have greater hardness and strength than common glass.

Suitable inorganic plastics include glass bonded mica, phosphol-asbestos compounds and calcium alumina-silicate compounds.

Cermets are a group of materials consisting of an intimate mixture of ceramic and metallic components. Cermets are fabricated by mixing finely divided components in the form of powders or fibers, compacting the components under pressure and sintering the compact to produce a material with physical properties not found solely in either of the components. Cermets can also be fabricated by internal oxidation of dilute solutions of a base metal and a more noble metal. When heated under oxidizing conditions, the oxygen diffuses into the alloy to form a base metal oxide in a matrix of the more noble material. Ceramic components may be metallic oxides, carbides, borides, silicides, nitrides or mixtures of these compounds. The metallic components include a wide variety of metals, such as aluminum, beryllium, copper, chromium, iron, silicon, molybdenum and nickel. Cermets can be applied to substrates by plasma spraying.

Cermets are one form of composite material. Other composite materials useful as the surface material on the roll of the present invention are those which are a matrix of a fiber or flake embedded in a suitable resin. The most commonly known form of composite material is fiberglass, which is a matrix of a glass fiber embedded in a polyester or epoxy resin. Other suitable fibers include those of boron and carbon.

In the method of the present invention, a pair of rolls is used through which a paper web is transported. One of the rolls has a solid surface of a material having a low thermal diffusivity of less than about $1\times10^{-6}$m$^2$/s. The other roll is formed of a suitable material, such as steel and aluminum. In one embodiment a web of a resilient material, such as felt, is interposed between the unheated roll and the paper web as it passes through the roll nip. In the practice of the method, the two rolls are urged together to provide a compressive force on the paper web as it is transported through the rolls. Preferably, the compressive force on the paper web is from about 0.3 MPa to about 5.0 MPa (50–830 psi).

The heated roll is heated to provide a surface temperature on the roll of from about 200° C. to about 400° C., preferably from about 230° C. to about 290° C.

The speed at which the paper web is transported between the pair of rolls can be adjusted to provide a variable residence time that the paper web remains in the nip of the rolls. The residence time can be from about 10 to about 200 ms., preferably about 20 to about 100 ms.

At the residence times and temperatures useful in the present invention and using a surface material having a thermal diffusivity of less than about $1\times10^{-6}$ m²/s. The total energy transferred to the paper web as it is transported through the rolls is from about 20 to about 50 kj/m².

The method of the present invention is useful for the impulse drying of paper webs having an initial moisture level of from about 50% to about 70%. The moisture level of the paper web after being subjected to impulse drying in accordance with the invention will be in the range of from about 40% to about 60%. All percentages used herein are by weight, unless otherwise specified.

The following Examples further illustrate various features of the invention but are intended to in no way limit the scope of the invention which is defined in the appended Claims.

EXAMPLE I

Laboratory scale impulse drying simulations were carried out utilizing the apparatus depicted in FIG. 1. The apparatus includes a frame 11 on which is mounted a hydraulic cylinder 13. The piston 15 of the hydraulic cylinder 13 actuates a heating head 17 through a load cell 19. A heating platen 21 is disposed at the lower extremity of the heating head 17. Heaters 23 are disposed within the heating head 17 for heating the platen 21. A thermocouple 25 is disposed in the heating head for measuring the surface temperature of the platen surface 21. A stand 27 holds a felt pad 29 against which the heating head is actuated by the hydraulic cylinder 13. In the following impulse drying simulations, the heating platen was either steel or a ceramic material. The ceramic material was a Na, K, Al, Ba silicates used as binding agents for mica to form a vacuum tight, glass based ceramic. The ceramic is manufactured by Cotronics Corporation of Brooklyn, N.Y. and identified as Type #914.

Paper hand sheets having 70 percent moisture were prepared and a series of simulations of impulse drying were conducted wherein the hydraulic cylinder was used to dry the hand sheets by impulse drying at various times, representing nip residence times, and various temperatures at a constant compression of 3 MPa. The plot of FIG. 2 depicting delamination zones as a function of residence time and temperature was prepared utilizing a series of impulse drying simulations. As can be seen in FIG. 2, the ceramic platen 21 provided significantly improved delamination properties as compared to a chrome plated steel platen which was also utilized in a series of simulations. As can be seen in FIG. 2, any residence time of up to about 125 milliseconds can be used at any surface temperature up to 400° C.

Hand sheets which were subjected to impulse drying simulation were tested for solids content after the impulse drying simulation. These impulse drying simulations were conducted at a temperature of 260° C. and a compression of 3 MPa. The plot of FIG. 3 was prepared utilizing the information obtained from this testing. As can be seen from FIG. 3, a somewhat smaller quantity of water was removed utilizing the ceramic platen as compared to the chrome plated steel platen. The amount of water removed, however, was acceptable for commercial operations.

The density and Z-direction modulus of the hand sheets subjected to impulse drying simulation were also measured to prepare the plots set forth in FIG. 4 and FIG. 5. These impulse drying simulations were conducted at a temperature of 260° C. and a compression of 3 MPa. As can be seen by an examination of FIG. 4 and FIG. 5, the use of a ceramic platen produced densities and Z-direction modulus which were substantially similar to the use of a chrome plated steel platen.

A further series of impulse drying simulations were performed on a series of hand sheets having a moisture of 70 percent. These impulse drying simulations were conducted at a temperature of 260° C. and a compression of 3 MPa. The instantaneous heat flux of the series of impulse drying simulations was determined and was used to prepare the plot set forth in FIG. 6. As can be seen from FIG. 6, the instantaneous heat flux of the ceramic platen resulted in substantially reduced instantaneous heat flux. While not wishing to be bound by any theory, it is believed that the reduction of the instantaneous heat flux is a substantial contributor to the improved delamination results obtained utilizing the ceramic platen.

A further series of hand sheets having a moisture content of 70% were subjected to simulated impulse heat drying to determine the energy transferred at various residence times. The exit solids of each hand sheet was also determined. These impulse drying simulations were conducted at a temperature of 260° C. and a compression of 3 MPa. The data obtained from this series of impulse heat simulations was used to prepare the plots set forth in FIGS. 7 and 8. As can be seen in FIG. 7, the total energy transferred by the ceramic platen was substantially less than the total energy transferred by the chrome steel plated platen. An examination of FIG. 8, however, shows that the total energy transferred by the ceramic platen is more efficient in reducing the solids content of the paper subjected to impulse drying. From the foregoing, it is readily apparent that the improved heating roll of the present invention having a heating surface with less than $1\times10^{-6}$ m²/s thermal diffusivity provides a substantial improvement in impulse drying with respect to energy transfer and lessened probability of delamination. Various aspects of the invention have been described with particularity; however, numerous variations and modifications will be readily apparent to one skilled in the art.

What is claimed is:

1. An apparatus for impulse drying of a web of paper, the apparatus comprising at least two rolls defining a nip through which the web of paper is passed with the rotation of the rolls, at least one of said rolls being a heated roll which is adapted for heating to a temperature of from about 200° C. to about 400° C., the heated roll being provided with a solid surface material having a thermal diffusivity of less than about $1\times10^{-6}$ m²/s, said surface of said heated roll being a material selected from the group consisting of ceramics and cermets, the rolls being disposed to define a nip to provide a compressive force on the web of paper in the range of from about 0.3 MPa to about 5.0 MPa.

2. An apparatus in accordance with claim 1 wherein said heated roll has a thermal diffusivity of from about $1\times10^{-7}$ to about $1\times10^{-6}$ m²/s.

3. An apparatus in accordance with claim 1 wherein said heated roll is a metal roll which is provided with a surface layer selected from the group consisting of ceramics and cermets.

* * * * *

UNITED STATES PATENT AND TRADEMARK OFFICE

CERTIFICATE OF CORRECTION

PATENT NO. : 5,353,521
DATED : October 11, 1994
INVENTOR(S) : David I. Orloff et al.

It is certified that error appears in the above-identified patent and that said Letters Patent is hereby corrected as shown below:

Column 1,
Line 5, above the caption "Field of the Invention" insert the following:

-- Governmental Rights

This invention was made with Government support under Contract No. DE-FG02-85CE40738 awarded by the Department of Energy. The government has certain rights in this invention. --

Signed and Sealed this

Twenty-fifth Day of December, 2001

*Attest:*

*Attesting Officer*

JAMES E. ROGAN
*Director of the United States Patent and Trademark Office*